US010342288B2

(12) United States Patent
Yoshida et al.

(10) Patent No.: US 10,342,288 B2
(45) Date of Patent: Jul. 9, 2019

(54) SHOE UPPER STRUCTURE AND SHOE

(71) Applicant: Mizuno Corporation, Osaka (JP)

(72) Inventors: Yohei Yoshida, Osaka (JP); Takashi Nakamura, Osaka (JP)

(73) Assignee: Mizuno Corporation, Osaka-shi (JP)

( * ) Notice: Subject to any disclaimer, the term of this patent is extended or adjusted under 35 U.S.C. 154(b) by 197 days.

(21) Appl. No.: 15/325,912

(22) PCT Filed: Mar. 8, 2016

(86) PCT No.: PCT/JP2016/057074
§ 371 (c)(1),
(2) Date: Jan. 12, 2017

(87) PCT Pub. No.: WO2016/152490
PCT Pub. Date: Sep. 29, 2016

(65) Prior Publication Data

US 2017/0156439 A1 Jun. 8, 2017

(30) Foreign Application Priority Data

Mar. 23, 2015 (JP) ..... 2015-060185

(51) Int. Cl.
*A43B 7/28* (2006.01)
*A43B 5/02* (2006.01)
(Continued)

(52) U.S. Cl.
CPC ..... *A43B 7/28* (2013.01); *A43B 5/02* (2013.01); *A43B 5/025* (2013.01); *A43B 13/04* (2013.01);
(Continued)

(58) Field of Classification Search
CPC . A43B 23/027; A43B 23/0275; A43B 23/025; A43B 23/08; A43B 23/0265; A43B 23/0245; A43B 23/07
See application file for complete search history.

(56) References Cited

U.S. PATENT DOCUMENTS 5,797,200 A * 8/1998 Hess ..... A43B 23/047 36/51
8,151,490 B2 * 4/2012 Sokolowski ..... A43B 5/12 36/50.1
(Continued)

FOREIGN PATENT DOCUMENTS

DE 1 929 930 12/1965
EP 2 338 371 6/2011
(Continued)

OTHER PUBLICATIONS

PCT Examiner, PCT International Preliminary Report on Patentability including English Translation of PCT Written Opinion of the International Searching Authority for International Application PCT/JP2016/057074, dated Sep. 26, 2017, 5 pages, International Bureau of WIPO, Geneva, Switzerland.
(Continued)

*Primary Examiner* — Shaun R Hurley
*Assistant Examiner* — Bao-Thieu Nguyen
(74) *Attorney, Agent, or Firm* — W. F. Fasse

(57) ABSTRACT

An upper structure for a shoe improves foot fit and hold of an upper at the time of turn motion. In an upper 2 that covers a foot of a shoe wearer, an expandable part 20 is provided at a midfoot region M that corresponds to a midfoot portion of the foot, and a non-expandable part 21 is provided at a lateral side region and a medial side region except for the midfoot region M. A boundary portion 22 between the expandable part 20 and the non-expandable part 21 has a substantially flat or flush surface. At the boundary portion
(Continued)

22, respective end portions 20E, 21E of the expandable part 20 and the non-expandable part 21 are sewn together such that a seam does not appear on the boundary surface. The shoe may further include an outsole having at least one groove in a particular triangular region on a bottom surface of the outsole.

17 Claims, 11 Drawing Sheets

(51) Int. Cl.

| | |
|---|---|
| ***A43B 13/04*** | (2006.01) |
| ***A43B 23/02*** | (2006.01) |
| ***A43C 15/16*** | (2006.01) |
| ***A43B 13/14*** | (2006.01) |
| ***A43B 23/04*** | (2006.01) |

(52) U.S. Cl.
CPC ..... *A43B 13/141* (2013.01); *A43B 23/021* (2013.01); *A43B 23/025* (2013.01); *A43B 23/027* (2013.01); *A43B 23/0215* (2013.01); *A43B 23/0275* (2013.01); *A43B 23/047* (2013.01); *A43C 15/16* (2013.01)

(56) References Cited

U.S. PATENT DOCUMENTS

| | | | | |
|---|---|---|---|---|
| 8,573,981 | B2 * | 11/2013 | Morag | A43B 5/025 434/251 |
| 2003/0131496 | A1 * | 7/2003 | Nakano | A43B 5/08 36/3 B |
| 2005/0193592 | A1 * | 9/2005 | Dua | A43B 1/04 36/45 |
| 2005/0282454 | A1 | 12/2005 | Meschter et al. | |
| 2006/0162190 | A1 * | 7/2006 | Nishiwaki | A43B 5/10 36/97 |
| 2008/0028640 | A1 | 2/2008 | Lacorazza | |
| 2009/0113766 | A1 * | 5/2009 | Hooper | A43B 5/02 36/133 |
| 2009/0205223 | A1 * | 8/2009 | Vlaho | A43B 3/00 36/103 |
| 2010/0331122 | A1 * | 12/2010 | Morag | A43B 5/025 473/422 |
| 2011/0041362 | A1 | 2/2011 | Nishiwaki et al. | |
| 2011/0247240 | A1 * | 10/2011 | Eder | A43B 1/0009 36/133 |
| 2012/0180335 | A1 | 7/2012 | Mahoney | |
| 2013/0247415 | A1 * | 9/2013 | Kohatsu | A43B 3/0031 36/88 |
| 2013/0255103 | A1 * | 10/2013 | Dua | A43B 1/04 36/87 |
| 2014/0245632 | A1 * | 9/2014 | Podhajny | A43B 1/04 36/45 |
| 2014/0352178 | A1 * | 12/2014 | Bruce | A43B 17/08 36/3 A |
| 2015/0216260 | A1 * | 8/2015 | Friedl | A43B 5/002 36/114 |
| 2015/0257476 | A1 * | 9/2015 | Panian | A43B 5/00 36/114 |
| 2015/0289595 | A1 * | 10/2015 | Rushbrook | A43C 11/22 36/50.1 |
| 2016/0183625 | A1 * | 6/2016 | Rezvi | A43B 3/24 36/100 |
| 2017/0143075 | A1 * | 5/2017 | Nonogawa | A43B 23/0235 |
| 2017/0188657 | A1 * | 7/2017 | Kohatsu | A43B 5/002 |
| 2017/0215517 | A1 * | 8/2017 | Silva | A43B 11/00 |
| 2017/0251762 | A1 * | 9/2017 | Gu | A43B 23/0235 |
| 2017/0370027 | A1 * | 12/2017 | da Costa Pereira Machado | A43B 23/025 |

FOREIGN PATENT DOCUMENTS

| | | | |
|---|---|---|---|
| JP | 50-41731 | U | 4/1975 |
| JP | 63-48165 | Y | 12/1988 |
| JP | 02-22101 | U | 2/1990 |
| JP | 2002-045204 | A | 2/2002 |
| JP | 2005-329270 | A | 12/2005 |
| JP | 4886922 | B2 | 2/2012 |

OTHER PUBLICATIONS

PCT International Search Report of the International Searching Authority for International Application PCT/JP2016/057074, dated Jun. 14, 2016, 2 pages, Japanese Patent Office, Tokyo, Japan.

European Examiner, Extended European Search Report for European Patent Application No. 16768393, dated Oct. 19, 2018, 8 pages, European Patent Office, Munich, Germany.

* cited by examiner

SHOE UPPER STRUCTURE AND SHOE

TECHNICAL FIELD

The present invention relates generally to an upper structure for a shoe, and more particularly, to an improvement of the structure that can improve foot fit and hold of an upper at the time of turn motion.

BACKGROUND ART

An upper structure for a shoe such as shown in JP patent application publication No. 2005-329270 is proposed. The publication describes that by providing an inside expandable part on a medial side of an upper and an outside expandable part on a lateral side of the upper respectively, when a shoe wearer raises a heel and bends a foot during activities, the inside expandable part and the outside expandable part of the upper expand and contract correspondingly to deformation of the foot thus improving foot fit of the upper (see paras. [0008]-[0011], [0032]-[0034] and [0056]-[0057] and FIGS. 3 to 6 of the publication).

However, the invention described in the above publication focused only on foot movements when raising the heel to bend the foot, and never considered foot movements at all during turn motion. On the other hand, at the time of turn motion, a push-off foot moves toward a lateral side of the upper, and therefore, when the expandable part is provided at the lateral side of the upper as shown in the above publication, foot hold of the upper relative to the push-off foot decreases at the time of turn motion.

PRIOR ART REFERENCES

Patent Documents

Japanese Patent Application Publication No. 2005-329270 (see paras. [0008]-[0011], [0032]-[0034] and [0056]-[0057], and FIGS. 3 to 6).

SUMMARY OF THE INVENTION

Objects to be Achieved by the Invention

The present invention has been made in view of these circumstances and its object is to provide an upper structure for a shoe that can improve foot fit and hold of an upper at the time of turn motion.

Means of Achieving the Objects

An upper structure for a shoe according to the present invention includes an upper to cover a foot of a shoe wearer. A portion of a medial side region of the upper is formed of an expandable part and a lateral side region of the upper is formed of a non-expandable part.

According to the present invention, since the lateral side region of the upper is formed of the non-expandable part, the non-expandable part disposed at the lateral side region of the upper supports a lateral side of the foot to hold the foot when a push-off foot moves toward the lateral side of the upper at the time of turn motion. Thereby, foot hold of the upper can be improved at the time of turn motion. Moreover, according to the present invention, since the portion of the medial side region of the upper is formed of the expandable part, the expandable part can follow a twist of the foot at the time of turn motion thus improving foot fit of the upper during turn motion.

The expandable part may be disposed at an area that corresponds to a medial longitudinal arch of the foot or a portion of said area. Here, "the medial longitudinal arch" is a region that extends from the inside of a calcaneus (i.e. a sustentaculum tali of the calcaneus) through a navicular bone and a first cuneiform bone to a distal end of a first metatarsus bone (i.e. a ball of the foot). Thereby, followability or following performance of the expandable part relative to a twist of the foot during turn motion can be enhanced, thus further improving foot fit of the upper during turn motion.

The expandable part may be disposed at an area that corresponds to a medial longitudinal arch of the foot or a portion of said area, and the non-expandable part may be disposed at the lateral side region and at the medial side region except for the expandable part.

A boundary portion or boundary between the expandable part and the non-expandable part may have a substantially flat or flush surface. Thereby, when such an upper structure is applied to a shoe such as a soccer shoe and the like that kicks a ball, a feel at the time of a ball-kick can be prevented from being impaired and controllability of the ball can thus be improved. Here, the term "a substantially flat or flush surface" includes a surface that is not so flat as a single expandable part or a single non-expandable part but should be regarded as a flat surface in the use of a shoe, which does not have a great difference or unevenness at a boundary line of the expandable part and the non-expandable part. The same applies hereafter.

The boundary portion may be formed by sewing together respective end portions of the expandable part and the non-expandable part.

A seam may be formed so that it does not appear on the boundary surface. Thereby, controllability of the ball can be further improved.

A shoe according to the present invention comprises an upper that covers a foot of a shoe wearer and an outsole that is provided at a lower part of the upper. A portion of a medial side region of the upper is formed of an expandable part and a lateral side region of the upper is formed of a non-expandable part. On a bottom surface of the outsole, a groove is formed at a triangular region or inside thereof that is composed by connecting a position corresponding to a thenar eminence region, a position corresponding to a hypothenar eminence region and a position corresponding to a sustentaculum tail portion of a calcaneus of the foot.

According to the present invention, since the groove is formed at the triangular region or inside thereof on the bottom surface of the outsole, the triangular region being composed by connecting the position corresponding to the thenar eminence region, the position corresponding to the hypothenar eminence region and the position corresponding to the sustentaculum tail portion of the calcaneus of the foot, bendabillity of the triangular region is improved and thus the thenar eminence region of the outsole is easy to twist relative to a heel region. Thereby, at the time of turn motion, the bottom surface of the outsole can come into sufficient contact with the ground, outsole grip relative to the ground can be enlarged and at the same time an inclined angle of a leg toward the direction of turn can be made greater. As a result, a ground reaction force toward the direction of turn can be fully obtained and a quick turn can be achieved.

According to the present invention, even when a push-off foot moves rapidly toward the lateral side of the upper at the time of such a quick turn motion, the non-expandable part of the lateral side region of the upper supports the lateral side of the foot securely, thus improving foot hold of the upper. Also, the expandable part on the medial side of the upper follows a rapid twist of the foot securely at the time of the quick turn motion, thereby improving foot fit of the upper.

The groove on the bottom surface of the out sole may comprise a plurality of grooves and may be distributed in the shape of a fan that starts from a position corresponding to the hypothenar eminence region or its adjacent area and that extends toward the medial side. In this case, at the time of turn motion, the thenar eminence region of the outsole gradually bends around the position corresponding to the hypothenar eminence region or its adjacent area. By so doing, bending of the outsole can be conducted in a smoother manner.

Effects of the Invention

As above-mentioned, according to the shoe upper structure of the present invention, by forming the upper lateral side region from the non-expandable part, when the push-off foot moves toward the lateral side of the upper at the time of turn motion, the non-expandable part disposed at the upper lateral side region supports the foot lateral side to hold the foot. Thereby, foot hold of the upper can be improved at the time of turn motion. Moreover, according to the present invention, since the portion of the upper medial side region is formed from the expandable part, the expandable part can follow a twist of the foot at the time of turn motion thus improving foot fit of the upper during turn motion.

BEST MODE FOR CARRYING OUT THE INVENTION

Embodiments of the present invention will be hereinafter described in accordance with the appended drawings.

FIGS. 1 to 11 show a shoe employing an upper structure according to an embodiment of the present invention. Here, a soccer shoe is taken as an example. In the description below, forward (front side/front) and rearward (rear side/rear) designate a longitudinal positional relationship of the shoe, and upward (upper side/upper) and downward (lower side/lower) designate a vertical positional relationship of the shoe.

Figure 1:
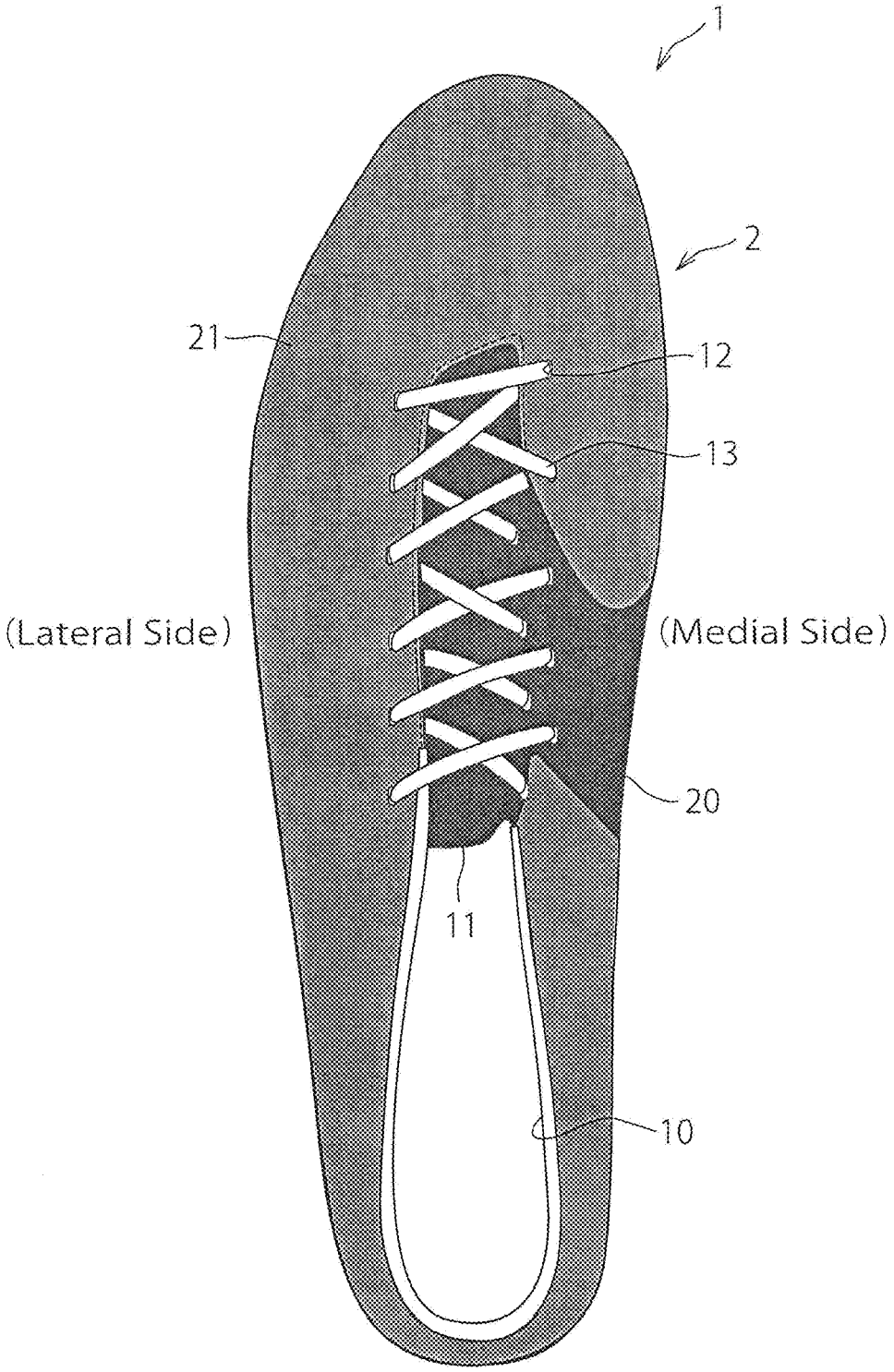
FIG. 1 is a top plan schematic view of a shoe employing an upper structure according to an embodiment of the present invention.
Figure 2:
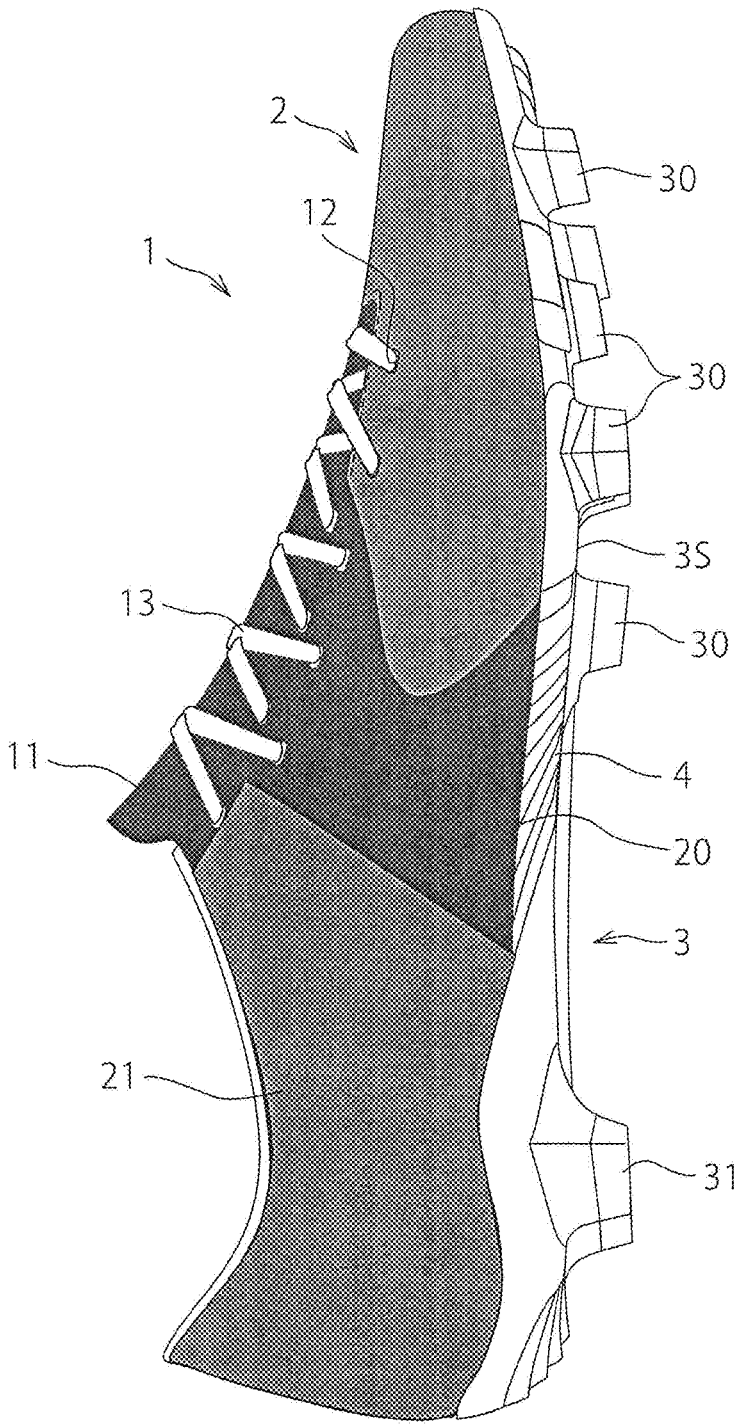
FIG. 2 is a medial side view of the shoe of FIG. 1.
Figure 3:
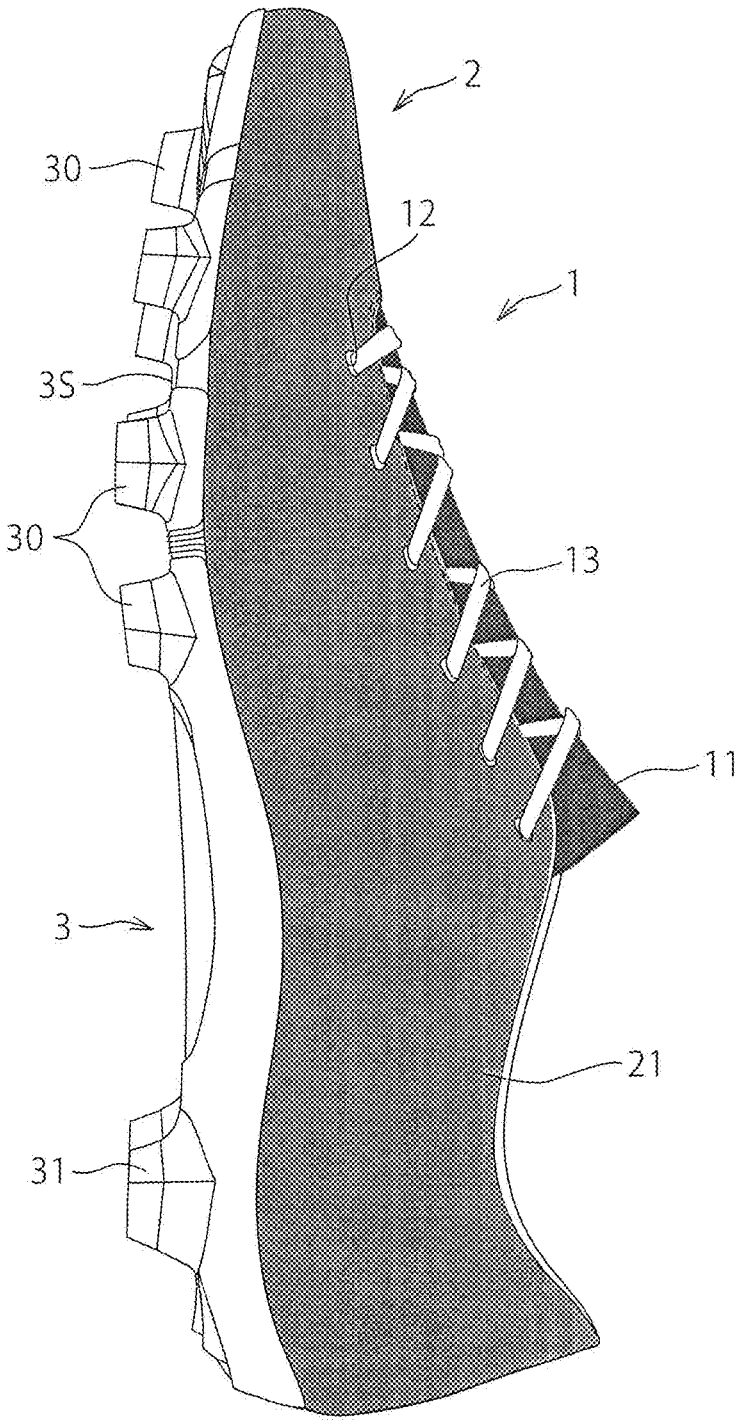
FIG. 3 is a lateral side view of the shoe of FIG. 1.

As shown in FIGS. 1 to 3, Shoe 1 includes an upper 2 that extends from a heel portion to a toe portion of a foot of a shoe wearer in such a way to cover the foot. The upper 2 is formed of an expandable part 20 (colored in black) disposed at a portion of the medial side region (in this example, a midfoot region), and a non-expandable part 21 (in a color excluding black) disposed at the remaining portions of the medial side region and at the lateral side region.

The expandable part 20 comprises material of a relatively higher expandability. As an outer material of the expandable part 20, for example, polyurethane or the like is used, and as a lining of the expandable part 20, for example, mesh, knitting or the like formed of polyester and polyurethane, etc. is used. In addition, the lining may be formed of a single material. Also, the outer material and the lining may be formed of other materials. For instance, expandable material including expandable fibers such as spandex may be used. Here, spandex is an elastic fiber that is formed by spinning polyurethane dissolved in a solvent. The non-expandable part 21 comprises material of a relatively lower expandability. As an outer material of the non-expandable part 21, for example, natural leather, artificial leather, synthetic leather, polyurethane, nylon or the like is used, and as a lining of the non-expandable part 21, for example, mesh or the like is used.

At an in step top portion of the upper 2, an aperture is formed that extends forwardly in connection with an opening 10. A tongue portion 11 is disposed in the aperture. In this exemplification, the tongue portion 11 is integrated with the medial side region of the upper 2 and colored in black as with the expandable part 20, but the tongue portion 11 may be formed of the material similar to the non-expandable part 21. Also, a plurality of eyelets 12 are formed through the upper 2 along the aperture of the in step top portion. A shoelace 13 is inserted into the eyelets 12.

An outsole 3 is fixedly attached to a lower portion of the upper 2 via bonding and the like. The outsole 3 is a thin plate-like member and preferably formed of a hard elastic material, for example, thermoplastic resin such as thermoplastic polyurethane (TPU), polyamide (PA), polyamide elastomer (PAE), ABS resin and the like, alternatively, thermosetting resin such as epoxy resin, unsaturated polyester resin and the like. A plurality of cleats 30, 31 are provided on a bottom surface 3S of the outsole 3. The cleats 30 are disposed at a forefoot region and the cleats 31 are disposed at a heel region.

Figure 4:
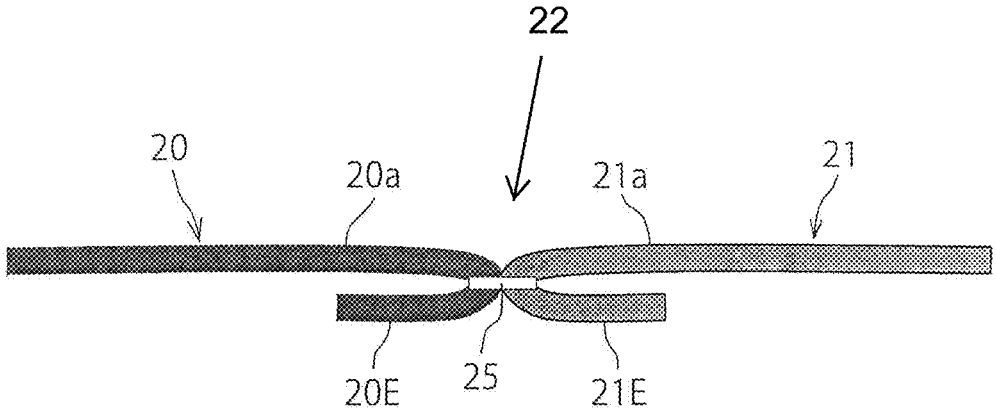
FIG. 4 is a schematic sectional view of a boundary portion between the expandable part and the non-expandable part of the upper structure of FIG. 1.

FIG. 4 shows a section of a boundary portion or boundary 22 between the expandable part 20 and the non-expandable part 21 of the upper 2. As shown in FIG. 4, at the boundary portion 22 between the expandable part 20 and the non-expandable part 21, an end portion 20E of the expandable part 20 and an end portion 21E of the non-expandable part 21 are folded back in a loop-shape to the back side of the upper 2. The folded-back portions of the expandable part 20 and the non-expandable part 21 are sewn together by a sewing thread 25. The sewing thread 25 does not appear on the front side (i.e. the front surface 20*a* of the expandable part 20 and the front surface 21*a* of the non-expandable part 21) of the boundary portion 22. Such a way of sewing is generally called "seam-opening sewing". As shown in FIG. 4, the boundary portion 22 between the expandable part 20 and the non-expandable part 21 is formed with a substantially flat or flush boundary surface, i.e. the expandable part 20 and the non-expandable part 21 are flush with one another at the boundary portion 22 as shown is FIG. 4.

Figure 8:
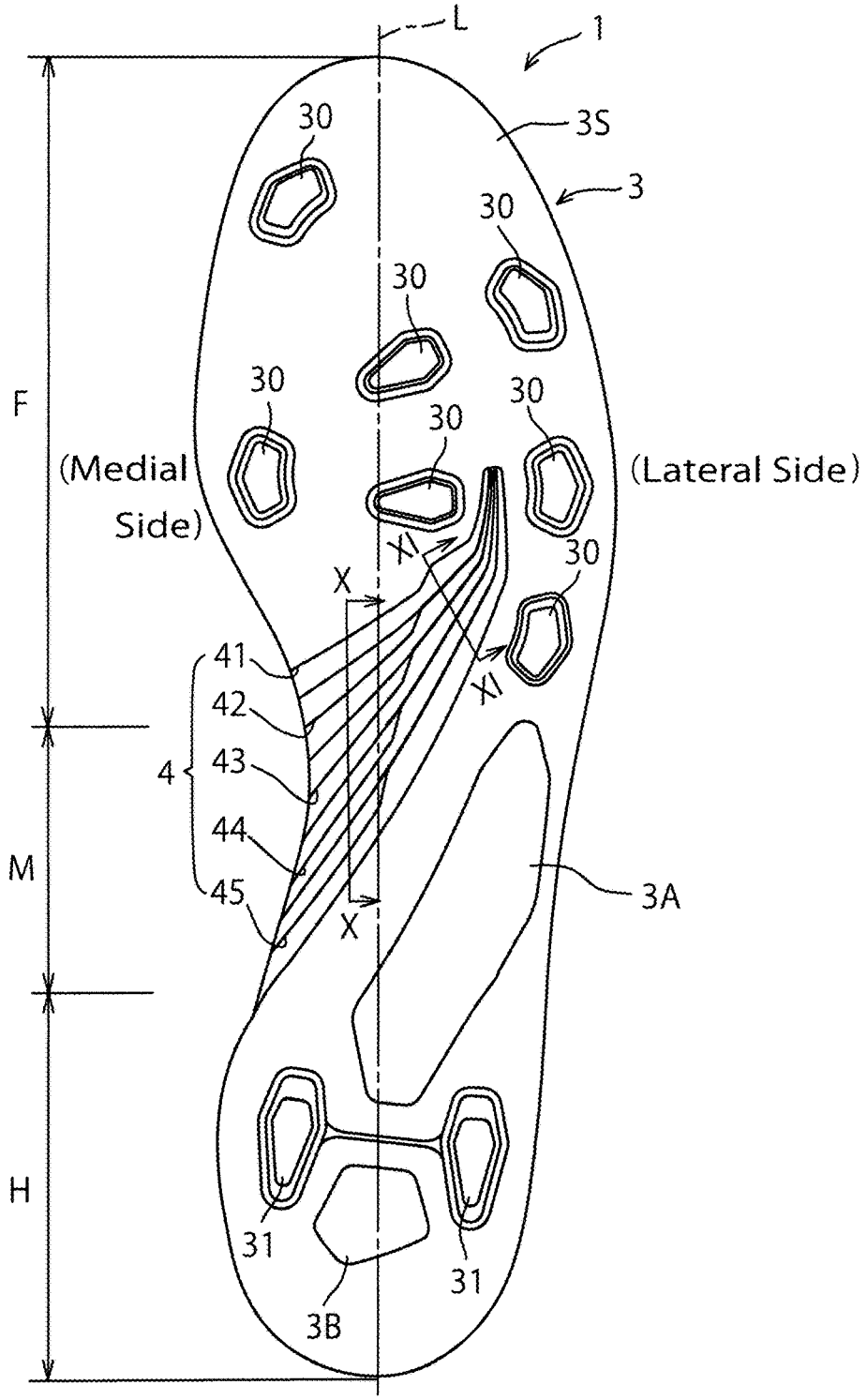
FIG. 8 is a bottom schematic view of the shoe of FIG. 1, illustrating the bottom surface of the outsole.

As shown in FIG. 8, on the bottom surface 3S of the outsole 3, a groove 4 comprising a plurality of grooves 41-45 is formed. The grooves 41-45 are distributed in the shape of a fan that starts from a position on the lateral side in the rear of the forefoot region F and that extends toward the medial side. Each of the grooves 41-45 is disposed avoiding the cleats 30 without overlapping with each of the cleats 30. Each of the grooves 41-45 extends gradually curvedly toward the medial side from the lateral side and is a curved groove or a generally linear groove. A distance between the adjacent grooves is wider at the medial side region than in the lateral side region and the distance becomes wider gradually or in stages toward the medial side from the lateral side.

Figure 9:
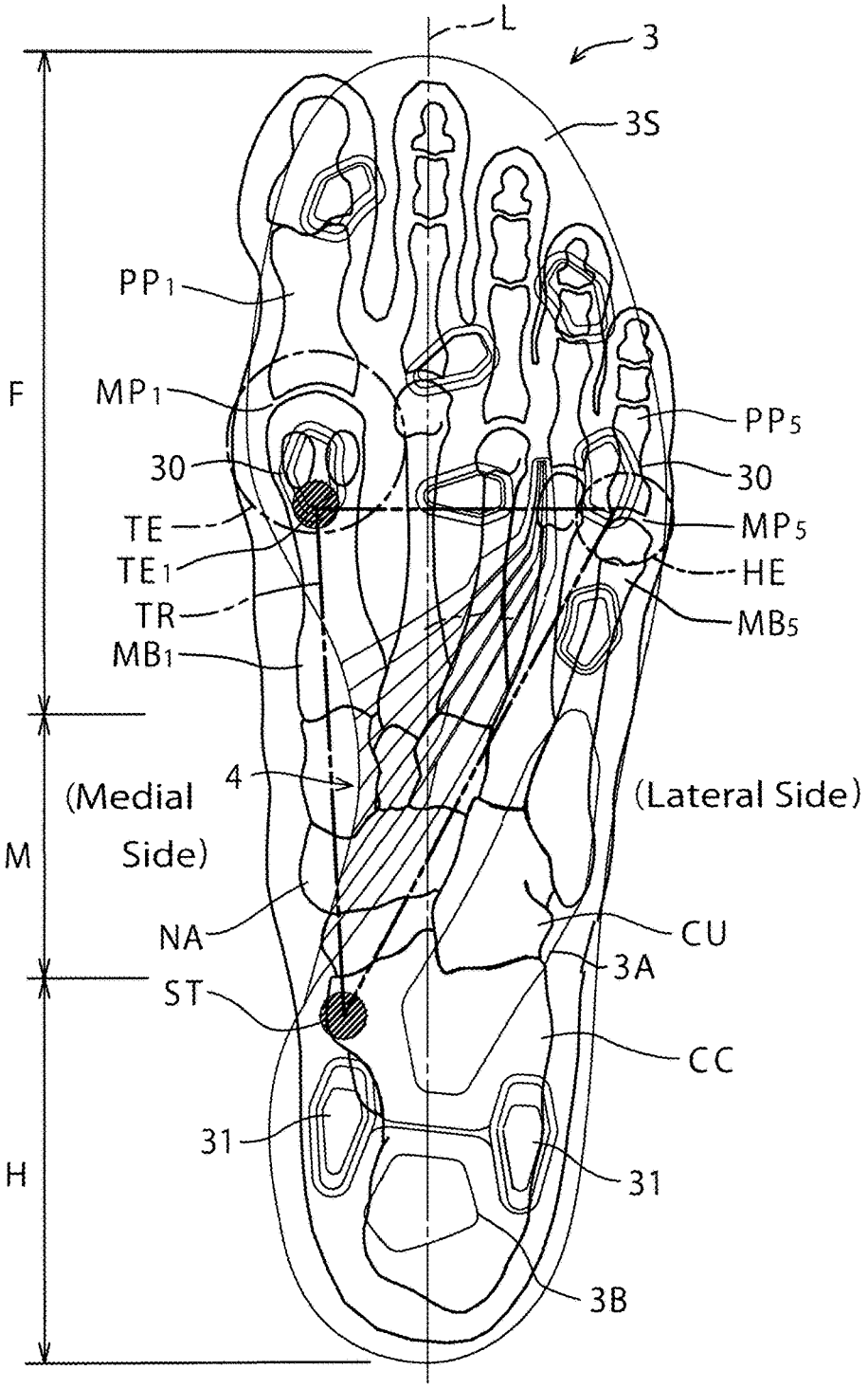
FIG. 9 shows a positional relationship between the bottom surface of the outsole (FIG. 8) and the bone structure of a foot.

FIG. 9 is a schematic bottom view that illustrates positional relationship between respective parts of the outsole 3 and the bone structure of the foot. In FIG. 9, a thenar eminence region TE is shown by a round region that is surrounded by a dashed line and that is distributed around a first metatarsophalangeal joint $MP_1$ between a first proximal phalanx $PP_1$ and a first metatarsus $MB_1$. Similarly, a hypothenar eminence region HE is shown by a round region that is surrounded by a dashed line and that is distributed around a fifth metatarsophalangeal joint $MP_5$ between a fifth proximal phalanx $PP_5$ and a fifth metatarsus $MB_5$. Also, a sustentaculum tail portion ST of a calcaneus CC is shown by a round hatched region. In addition, a reference numeral CU designates a cuboid bone and a reference numeral NA designates a navicular bone.

The groove 4 is disposed in a triangular region TR (see a bold double dotted line) that is formed by connecting a position inside the thenar eminence region TE, a position inside the hypothenar eminence region HE and a position inside the sustentaculum tail portion ST of the calcaneus CC of the foot. Preferably, the triangular region TR is formed by connecting a part $TE_1$ (see hatched round area) located in the rear of the thenar eminence region TE, a central part in the hypothenar eminence region HE and a central part in the sustentaculum tail portion ST.

The groove 4 extends diagonally rearwardly toward the medial side from the lateral side in the triangular region TR. In this exemplification, the groove 4 is distributed at a partial area of the triangular region TR, but it may be distributed at an entire area of the triangular region TR. In this embodiment, the starting point of the groove 4 is located outside the triangular region TR in the vicinity of the hypothenar eminence region HE, but it may be located at or inside a boundary line of the triangular region TR, alternatively, inside the hypothenar eminence region HE.

As can be seen from FIG. 9, a cleat 30 on the medial side of the forefoot region F is disposed at a position corresponding to the thenar eminence region TE, a cleat 30 on the lateral side of the forefoot region F is disposed at a position corresponding to the hypothenar eminence region HE, and a cleat 31 on the medial side of the heel region H is disposed in the vicinity of the sustentaculum tail portion ST. The starting point of the groove 4 is located at any positions between the medial-side cleat 30 and the lateral-side cleat 30 at the forefoot region F.

Figure 10:
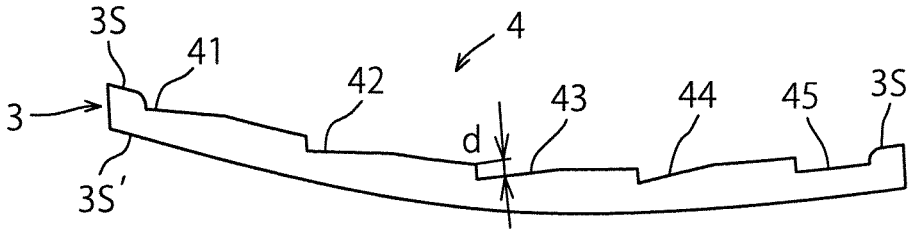
FIG. 10 is a sectional view of FIG. 8 taken along line X-X.
Figure 11:
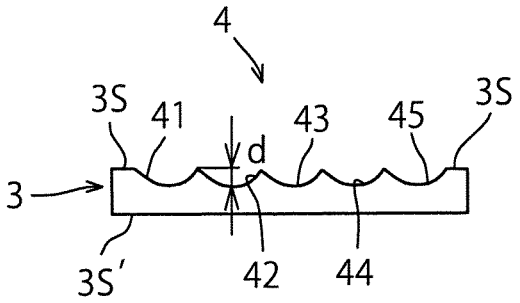
FIG. 11 is a sectional view of FIG. 8 taken along line XI-XI.

As for a cross sectional shape of each of the grooves 41-45, it is generally triangular shape at the medial side region as shown in FIG. 10 (hatching omitted), a sectional view of FIG. 8 taken along line X-X, and it is generally arc shape at the lateral side region as shown in FIG. 11 (hatching omitted), a sectional view of FIG. 8 taken along line XI-XI. However, the cross sectional shape at the medial side region may be the same as the cross sectional shape at the lateral side region. In this embodiment, a depth of each of the grooves 41-45 is d at both the medial side region and the lateral side region, but the depth may be altered between the medial side region and the lateral side region. Additionally, a reference numeral 3S' in FIGS. 10 and 11 depicts a foot-contact-side surface of the outsole 3.

As shown in FIGS. 8 and 9, high-rigidity areas 3A and 3B of higher rigidity than the triangular region TR are provided on the lateral side of the triangular region TR. The high-rigidity areas 3A and 3B are preferably formed of hard elastic materials, more specifically, thermoplastic resin such as thermo plastic polyurethane (TPU), polyamide (PA), polyamide elastomer (PAE), acrylonitrile-butadiene-styrene (ABS) resin and the like, or thermosetting resin such as epoxy resin, unsaturated polyester resin and the like. Alternatively, the high-rigidity areas 3A and 3B may be formed of fiber reinforced plastics (FRP) formed of reinforcing fibers such as carbon fibers, aramid fibers, glass fibers or the like and matrix resin such as thermosetting resin or thermoplastic resin. In addition, these high-rigidity areas 3A and 3B may be omitted.

The expandable part 20 of the upper 2 is preferably disposed at an area that corresponds to a medial longitudinal arch of the foot or at a portion of the area of the medial longitudinal arch. Here, the "medial longitudinal arch" is a region that extends from the inside of the calcaneus CC, that is, the sustentaculum tail portion ST (see FIG. 9) of the calcaneus CC through the navicular bone NA and the first cuneiform bone to the distal end of the first metatarsus $MB_1$, that is, the thenar eminence region TE (see FIG. 9) of the foot. In this embodiment, as shown in FIG. 2, a lower portion of the expandable part 20 of the upper 2 is disposed at an area that corresponds to a portion of the medial longitudinal arch of the foot. A rear side edge portion of the expandable part 20 extends generally linearly toward the in step top portion and also in a ball girth direction, and a front side edge portion of the expandable part 20 extends crookedly rearwardly and then extends toward the in step top portion. In addition, the front side edge portion may extend generally linearly toward the in step top portion and also in the ball girth direction, similarly to the rear side edge portion.

The elongation rate of the expandable part 20 of the upper 2 is set at a value of 7-15%, preferably 10-12%, and the elongation rate of the non-expandable part 21 is set at a value of less than 5%. The measurement of the elongation rate of the expandable part 20 and the non-expandable part 21 is conducted as follows:

(1) Test Method;

The constant-speed-expansion method based on the A-method (Strip-method) of "Testing methods for woven and knitted fabrics" in JIS (Japanese Industrial Standard) L 1096 8. 14. 1. A test piece is held and pulled by a tensile tester and thereafter an elongation rate is measured.

(2) Test Conditions;

Holding Span of the test piece: 200 [mm]

Tension Rate: 200 [mm/min.]

(3) Calculation Method of the Elongation Rate;

$$\text{Elongation Rate (\%)}=(L1-L0)/LO\times 100$$

LO: holding span

L1: holding span at acting of the load of 29.4[N]

Here, JIS defines the elongation rate at acting of the load of 14.7 [N] (or 1.5 [kgf]) but it also describes that any load can be adopted. Therefore, the load of 29.4 [N] was employed here.

(4) Test Results;

As a test piece for the expandable part 20, expandable knitted mesh material (comprising polyester yarn and urethane yarn) on which expandable PU film (approximately 0.3 [mm] in thickness) and hot-melt adhesive are thermo-compressed was prepared, and as a test piece for the non-expandable part 21, artificial leather on which hardly-expandable textile mesh material and hot-melt adhesive are thermo-compressed was prepared. The test results of the tensile test are mentioned below.

Elongation rate of expandable part 20: 11.1[%]

Elongation rate of non-expandable part 21: 3.8[%]

Then, effect of the embodiment of the present invention will be explained.

According to the upper structure of the embodiment, since the lateral side region of the upper 2 is formed of the non-expandable part 21 (see FIGS. 1 and 3), the non-expandable part 21 disposed at the lateral side region of the upper 2 supports a lateral side of the foot to hold the foot when a push-off foot moves toward the lateral side of the upper 2 at the time of turn motion. Thereby, foot hold of the upper 2 can be improved at the time of turn motion. Moreover, according to the embodiment, since the midfoot region, i.e. a portion of the medial side region of the upper 2 (alternatively, a region corresponding to a portion of the medial longitudinal arch of the foot) of the upper 2 is formed of the expandable part 20 (see FIGS. 1 and 2), the expandable part 20 can follow a twist of the foot at the time of turn motion thus improving foot fit of the upper 2 during turn motion.

Also, the boundary portion 22 between the expandable part 20 and the non-expandable part 21 has a substantially flat or flush surface without steps, i.e. the expandable part 20 and the non-expandable part 21 are flush with one another at the boundary portion 22 (see FIG. 4). Thereby, when such an upper structure is applied to a shoe such as a soccer shoe and the like that kicks a ball, a feel at the time of a ball-kick can be prevented from being impaired and ball controllability can thus be improved. Moreover, since a seam does not appear at the boundary portion 22 between the expandable part 20 and the non-expandable part 21 (see FIG. 4), ball controllability can be further improved.

Furthermore, since the groove 4 is formed at the triangular region TR or at a portion inside thereof on the bottom surface 3S of the outsole 3 (see FIGS. 8 and 9), the triangular region TR being formed by connecting the position corresponding to the thenar eminence region TE, the position corresponding to the hypothenar eminence region HE and the position corresponding to the sustentaculum tail portion ST of the calcaneus CC, bendabillity of the triangular region TR is improved and thus the thenar eminence region TE of the outsole 3 is easy to twist relative to the heel region H. Thereby, at the time of turn motion, the bottom surface 3S of the outsole 3 can come into sufficient contact with the ground, grip power relative to the ground can be enlarged and at the same time the inclined angle of a leg toward the direction of turn can be made greater. As a result of this, a ground reaction force toward the direction of turn can be fully obtained and a quick turn can be achieved.

Even when the push-off foot moves rapidly toward the lateral side of the upper 2 at the time of such a quick turn motion, the non-expandable part 21 of the lateral side region of the upper 2 supports the lateral side of the foot securely to hold the foot, thus improving foot hold of the upper. Also, the expandable part 20 on the medial side of the upper 2 follows a rapid twist of the foot securely at the time of the quick turn motion, thereby improving foot fit of the upper 2.

Moreover, because the distance between the adjacent grooves 41-45 is gradually wider toward the medial side region from the lateral side region, the outsole 3 can gradually bend in stages from the groove 45 on the rear side to the groove 41 on the front side when a region of the outsole 3 corresponding to the thenar eminence TE bends relative to the heel Region H. In such a manner, bending of the outsole 3 can be conducted in a smooth manner. Furthermore, since the high-rigidity areas 3A and 3B of higher rigidity than the triangular region TR are provided on the lateral side of the triangular region TR, the triangular region TR is relatively easier to bend than the high-rigidity areas 3A and 3B on the lateral side of the triangular region TR, such that thereby bendability of the triangular region TR is relatively improved.

The preferred embodiment of the present invention has thus been explained, but application of the present invention is not limited to such an embodiment and the present invention includes various variants. Some of these variants will be given below. In the drawings that show the variants, reference numerals which are the same as those of the above embodiment indicate the same or corresponding parts.

<First Variant>

The above embodiment showed an example in which the end portion 20E of the expandable part 20 and the end portion 21E of the non-expandable part 21 are sewn together by "seam-opening sewing" using the sewing thread 25 (see FIG. 4) at the boundary portion 22 between the expandable part 20 and the non-expandable part 21 of the upper 2, but application of the present invention is not limited to such an embodiment.

Figure 5:
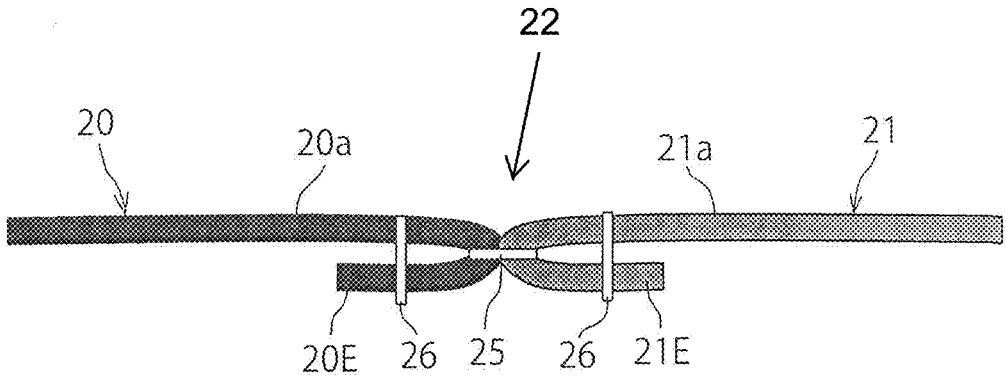
FIG. 5 shows a variant of FIG. 4.
Figure 6:
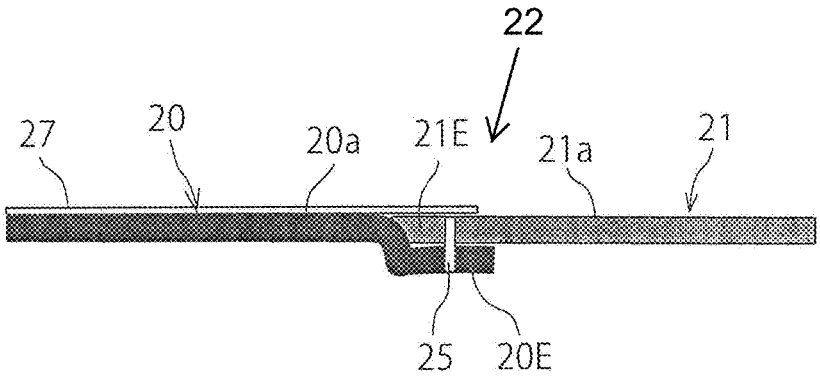
FIG. 6 shows another variant of FIG. 4.
Figure 7:
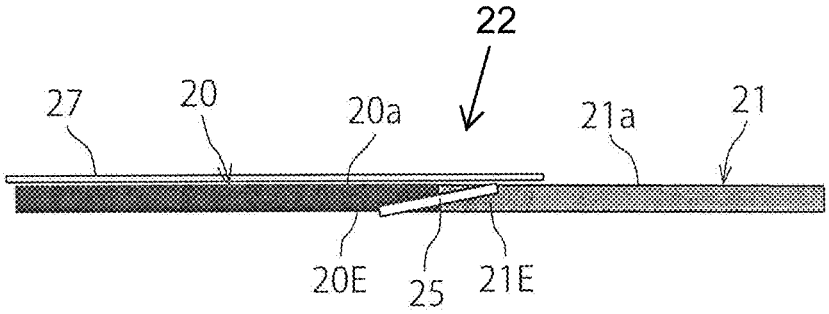
FIG. 7 shows a further variant of FIG. 4.

FIGS. 5 to 7 show other examples of the way of sewing to form the boundary portion or boundary 22 between the expandable part 20 and the non-expandable part 21. In FIG. 5, as with the above embodiment, the end portion 20E of the expandable part 20 and the end portion 21E of the non-expandable part 21 are folded back in a loop-shape to the back side of the upper 2 and the folded-back portions of the expandable part 20 and the non-expandable part 21 are sewn together by the sewing thread 25. Also, as shown in FIG. 5, upper portions on both sides of the sewing thread 25 are respectively sewn together by another sewing threads 26. Such a way of sewing is generally called "seam-lapped sewing". As shown in FIG. 5, the boundary portion 22 between the expandable part 20 and the non-expandable part 21 is formed with a substantially flat or flush boundary surface.

In FIG. 6, the end portion 21E of the non-expandable part 21 is overlapped on the end portion 20E of the expandable part 20 and the two end portions 20E, 21E are sewn together by the sewing thread 25. Such a way of sewing is generally called "superimposed sewing". Also, in FIG. 6, a thin resin sheet (e.g. a polyurethane (PU) sheet, etc.) 27 is thermo-compressed on the surface of the boundary portion 22 between the expandable part 20 and the non-expandable part 21. By so doing, the sewing thread 25 does not appear on the front side of the boundary portion 22 and the boundary portion 22 has the most nearly flat surface.

In FIG. 7, the end portion 20E of the expandable part 20 and the end portion 21E of the non-expandable part 21 are butted against each other and sewn together by the sewing thread 25. Such a way of sewing is generally called "seam-butted sewing". Also, similar to FIG. 6, a thin resin sheet 27 such as a PU sheet or the like is thermo-compressed on the surface of the boundary portion 22 between the expandable part 20 and the non-expandable part 21. In this manner, the sewing thread 25 does not appear on the front side of the boundary portion 22 and the boundary portion 22 has the most nearly flat surface.

<Second Variant>

Figure 12:
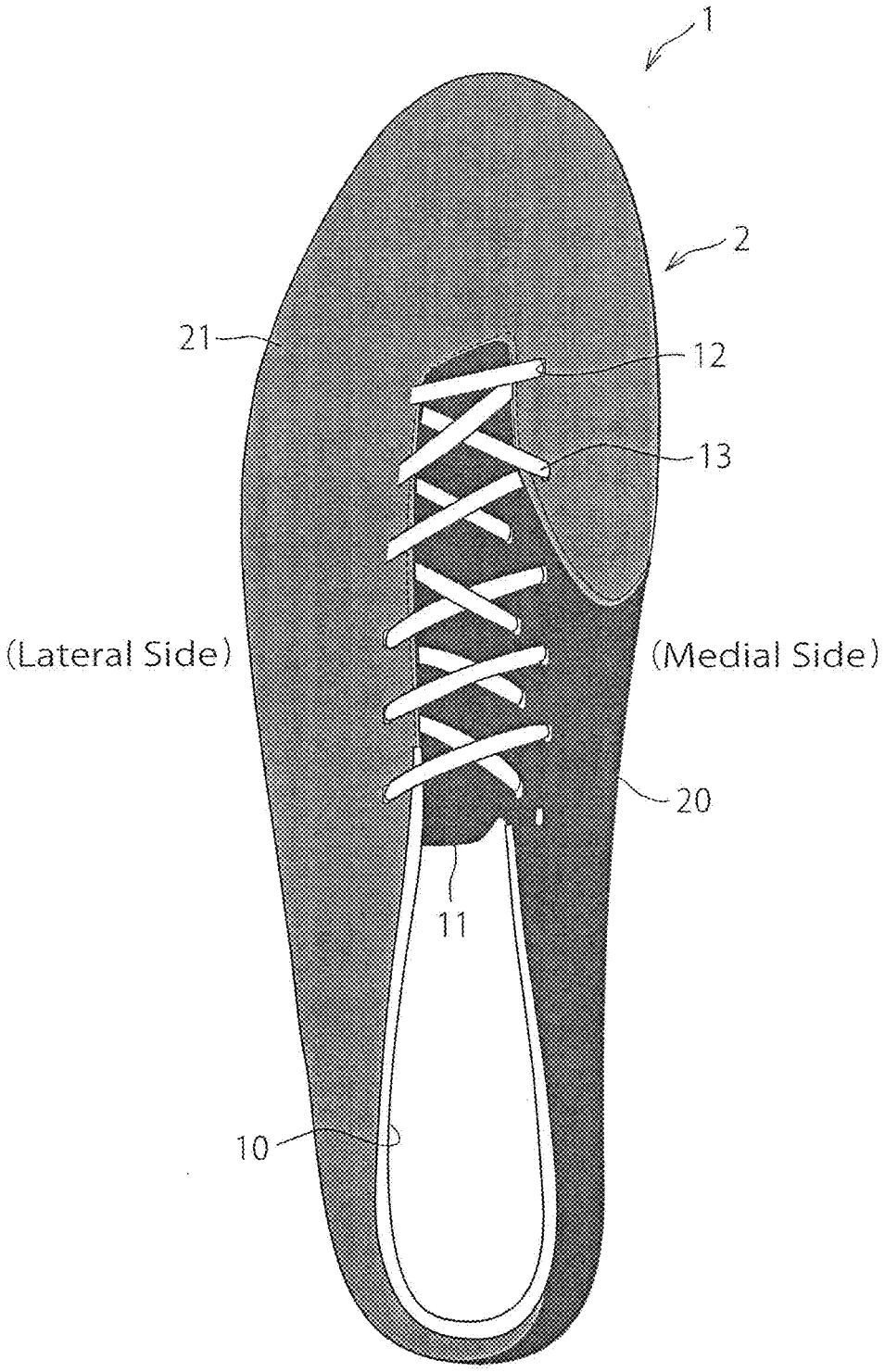
FIG. 12 is a top plan schematic view of a shoe employing an upper structure according to an alternative embodiment of the present invention.
Figure 13:
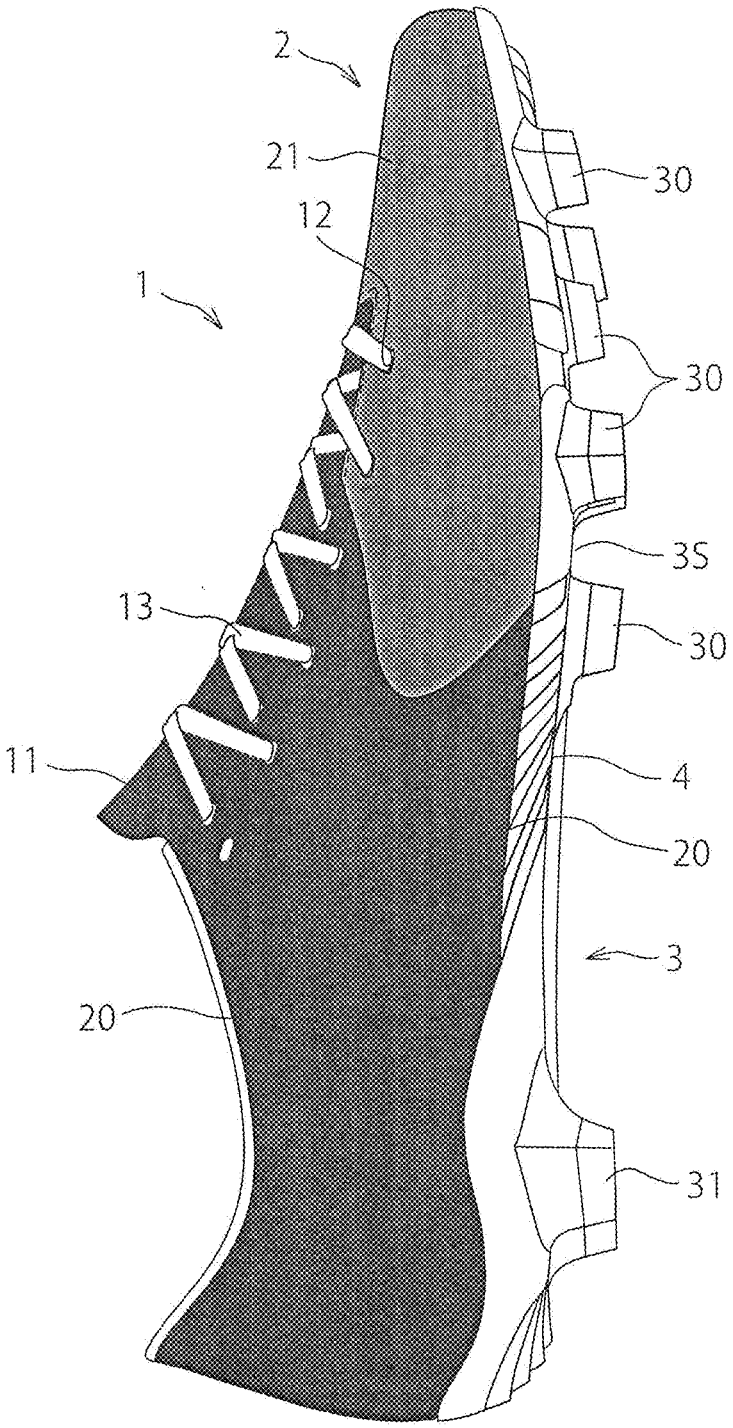
FIG. 13 is a medial side view of the shoe of FIG. 12.
Figure 14:
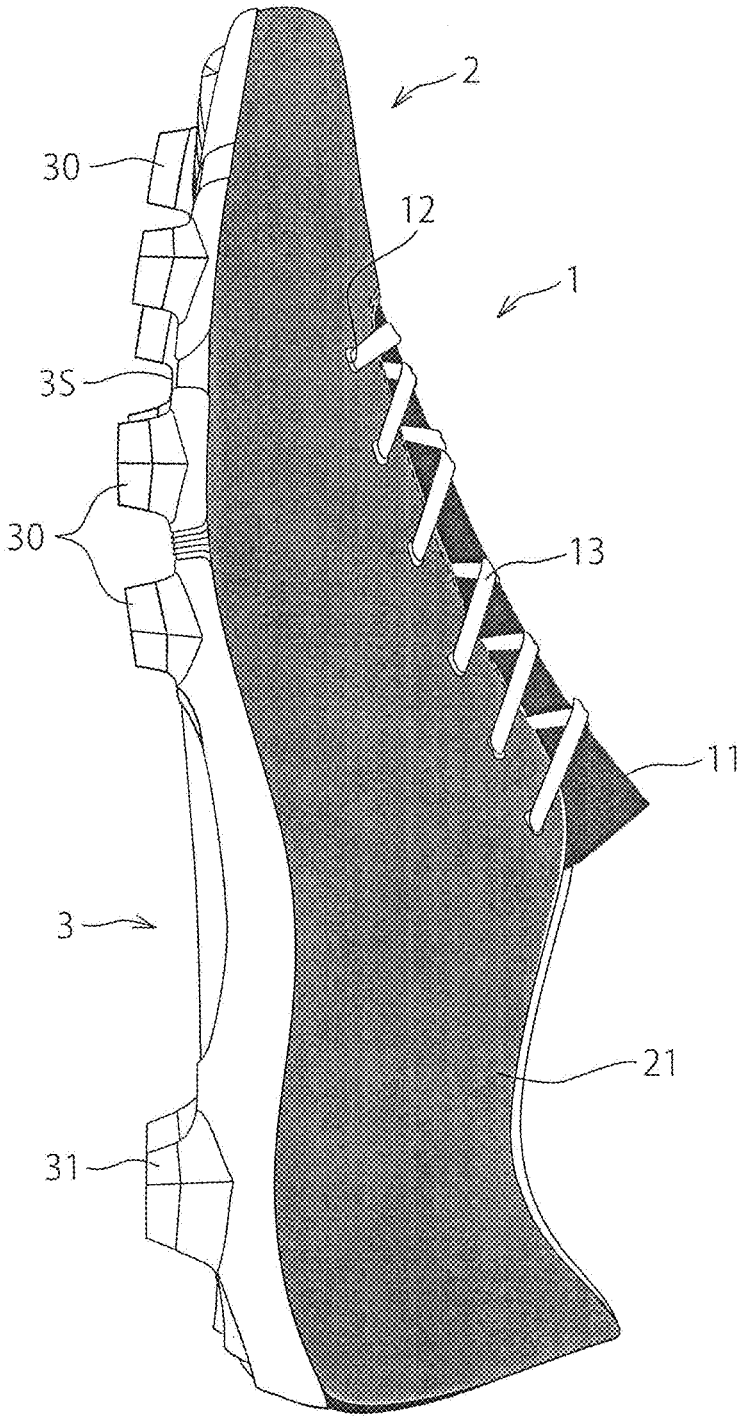
FIG. 14 is a lateral side view of the shoe of FIG. 12.

FIGS. 12 to 14 show a shoe employing an upper structure according to an alternative embodiment of the present invention.

In the above embodiment, an example was shown in which the expandable part 20 of the upper 2 is disposed at the midfoot region, i.e. a portion of the medial side region of the upper 2 (that is, the region corresponding to a portion of the medial longitudinal arch of the foot), alternatively, the region corresponding to the medial longitudinal arch of the foot, but in this alternative embodiment, the expandable part 20 is disposed at the medial side region of the upper 2 that extends from the midfoot region to the rear side thereof. As shown in FIGS. 12 and 13, the position and shape of the front end edge portion of the expandable part 20 is similar to those of the above embodiment, but the rear end edge portion of the expandable part 20 extends to a heel rear end (see FIGS. 12 and 14). Additionally, in this alternative embodiment, the shape of the rear end edge portion of the expandable part 20 at the heel rear end is configured so as to cross the heel rear end diagonally downwardly from the lateral side to the medial side, but the shape of the rear end edge portion is not restricted thereto. It may be formed to cross the heel rear end diagonally upwardly from the lateral side to the medial side and alternatively it may be formed to extend vertically straight at the heel rear end.

<Third Variant>

In the embodiment mentioned above, an example was shown in which the groove 4 formed on the bottom surface 3S of the outsole 3 extends from the lateral side to the medial side diagonally rearwardly in a gradually curved shape, but the slope and shape of the groove 4 are not limited thereto. Other slopes may be adopted and the groove 4 may extend linearly. Also, the groove 4 may not cross a longitudinal centerline L and may be disposed at either one region (i.e. the medial side region or the lateral side region) divided by the longitudinal centerline L. The number of the groove 4 and the distance between the adjacent grooves 41-45 are not limited to the above embodiment either. Other numbers may be adopted and each of the grooves 41-45 may be disposed in parallel with each other. Moreover, the cross sectional shape of the groove 4 is not limited to that shown in the above embodiment and can adopt other arbitrary shapes.

<Another Variant>

The above-mentioned embodiment and respective variants are to be considered in all respects only as illustrative of the present invention and not restrictive. Those skilled in the art to which the invention pertains may make various modifications and other embodiments employing the principles of this invention without departing from its spirit or essential characteristics particularly upon considering the foregoing teachings even when there are no explicit descriptions in this specification.

<Other Applications>

In the above-mentioned embodiment, the upper structure of the present invention was applied to soccer shoes, but application of the present invention is not limited thereto. The present invention also has application to other sports shoes such as rugby shoes, American football shoes, futsal shoes, and the like.

INDUSTRIAL APPLICABILITY

As mentioned above, the present invention is of use to an upper structure for a shoe, and it is especially suitable for a sports shoe that requires improved foot fit and hold of an upper at the time of turn motion.

DESCRIPTION OF REFERENCE NUMERALS

1: shoe
2: upper
20: expandable part
21: non-expandable part
22: boundary portion
25: sewing thread
3: outsole
3S: bottom surface
4: groove
TE: thenar eminence region
HE: hypothenar eminence region
ST: sustentaculum tail portion
CC: calcaneus
TR: triangular region

The invention claimed is:

1. An upper structure for a shoe, said upper structure including an upper configured and adapted to cover a foot of a shoe wearer, wherein:

a first portion of a medial side region of said upper is formed of an expandable part, a lateral side region of said upper is formed of a non-expandable part, said first portion of said medial side region formed of said expandable part is devoid of said non-expandable part, said upper further includes a tongue portion that is formed by said expandable part, and said expandable part and said non-expandable part are joined to one another at a boundary that is configured without overlapping of said expandable part and said non-expandable part.

2. The upper structure according to claim 1, wherein said first portion of said medial side region formed of said expandable part is disposed at a first area of said upper that is configured and arranged to correspond to a medial longitudinal arch of the foot or is disposed at a portion of said first area.

3. The upper structure according to claim 2, wherein said first portion of said medial side region formed of said expandable part is further disposed at a second area of said upper extending contiguously from said first area rearwardly to and onto a rear end heel portion of said upper.

4. The upper structure according to claim 2, wherein said non-expandable part is disposed at said lateral side region and at a second portion of said medial side region different from said first portion formed of said expandable part and is not disposed at said first portion.

5. The upper structure according to claim 4, wherein said medial side region further comprises boundary portions that each comprise one of said boundaries at which said expandable part and said non-expandable part are joined to one another, and wherein said first portion, said second portion and said boundary portions together make up an entirety of said medial side region of said upper.

6. The upper structure according to claim 1, wherein said expandable part and said non-expandable part are flush with one another at said boundary at which said expandable part and said non-expandable part are joined to one another.

7. The upper structure according to claim 1, wherein said boundary has a configuration as results from sewing together respective end portions of said expandable part and said non-expandable part.

8. The upper structure according to claim 7, wherein no stitched seam is visible at said boundary from an outer side of said upper structure.

9. The upper structure according to claim 7, wherein said configuration of said boundary is a configuration as results from seam-opening sewing as said sewing.

10. The upper structure according to claim 7, wherein said configuration of said boundary is a configuration as results from seam-butted sewing as said sewing.

11. The upper structure according to claim 7, wherein said configuration of said boundary is a configuration as results from seam-lapped sewing as said sewing.

12. The upper structure according to claim 1, wherein said boundary is configured without any step.

13. The upper structure according to claim 1, wherein said boundary is configured without any protrusion beyond an outer surface of said expandable part and said non-expandable part.

14. A shoe configured and adapted to be worn on a foot of a shoe wearer, wherein said shoe comprises:

an upper that is configured to cover the foot of the shoe wearer; and an outsole that is provided at a lower part of said upper;

wherein a first portion of a medial side region of said upper is formed of an expandable part, a lateral side region of said upper is formed of a non-expandable part, said first portion of said medial side region formed of said expandable part is devoid of said non-expandable part, said upper further includes a tongue portion that is formed by said expandable part, and said expandable part and said non-expandable part are joined to one another at a boundary that is configured without overlapping of said expandable part and said non-expandable part, and wherein at least one groove is formed respectively as at least one recess or indentation that penetrates into a bottom surface of said outsole, within a triangular region of said outsole defined by connecting a first position that is located on said bottom surface so as to correspond to a location of a thenar eminence region of the foot, a second position that is located on said bottom surface so as to correspond to a location of a hypothenar eminence region of the foot, and a third position that is located on said bottom surface so as to correspond to a location of a sustentaculum tail portion of a calcaneus of the foot.

15. The shoe according to claim 14, wherein said at least one groove comprises a plurality of grooves, and said grooves are arranged so that a respective spacing distance between adjacent ones of said grooves becomes wider as said grooves progress toward a medial side of said outsole.

16. A shoe upper comprising:

an expandable component that forms an expandable portion of a medial side of said shoe upper and that forms a tongue portion of said shoe upper;

a non-expandable component that forms a lateral side of said shoe upper and does not extend onto said expandable portion of said medial side of said shoe upper; and a junction component that joins said expandable component with said non-expandable component in a boundary portion of said shoe upper;

wherein:

said non-expandable component exhibits a lower tensile elongation rate than said expandable component;

said junction component comprises a stitching thread; and said expandable portion of said medial side of said shoe upper extends continuously and entirely from an instep opening at a top of said shoe upper to a bottom edge of said medial side of said shoe upper.

17. The upper structure according to claim 16, wherein said expandable component and said non-expandable component do not overlap one another in said boundary portion.

* * * * *